US007021818B2

(12) United States Patent
Haefeli et al.

(10) Patent No.: US 7,021,818 B2
(45) Date of Patent: Apr. 4, 2006

(54) CHRONOGRAPH COUPLING MECHANISM

(75) Inventors: Pierre Haefeli, Saules (CH); Alphonse Bron, Bassecourt (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 331 days.

(21) Appl. No.: 10/678,157

(22) Filed: Oct. 6, 2003

(65) Prior Publication Data

US 2004/0066711 A1 Apr. 8, 2004

(30) Foreign Application Priority Data

Oct. 4, 2002 (CH) ..... 1662/02

(51) Int. Cl.
*G04F 7/00* (2006.01)
*G04F 8/00* (2006.01)

(52) U.S. Cl. ..... 368/101; 368/103; 368/106

(58) Field of Classification Search ..... 368/101–106, 368/110

See application file for complete search history.

(56) References Cited

U.S. PATENT DOCUMENTS

| | | | | |
|---|---|---|---|---|
| 5,113,382 | A | 5/1992 | Bron | |
| 5,220,541 | A * | 6/1993 | Vuilleumier | 368/88 |
| 6,761,478 | B1 * | 7/2004 | Schmiedchen et al. | 368/101 |

FOREIGN PATENT DOCUMENTS

| | | |
|---|---|---|
| CH | 678911 G A3 | 11/1991 |
| EP | 1 136 894 A1 | 9/2001 |

OTHER PUBLICATIONS

European Search Report completed Jul. 9, 2003 in EP 02 07 9166.

* cited by examiner

*Primary Examiner*—Kamand Cuneo
*Assistant Examiner*—Jeanne-Marguerite Goodwin
(74) *Attorney, Agent, or Firm*—Griffin & Szipl, P.C.

(57) ABSTRACT

The coupling wheel (17) is brought into friction with an intermediate second wheel (19), or, conversely, to moved away therefrom by a fork (16) formed in the large arm (22) of an L-shaped coupling spring (20), articulated at the joining portion of the two arms (22, 24) on an adjustment plate (30), the small arm (24) of said coupling spring (20) having its end stressed by the end of a control lever (10). Means for guiding (32*a*, 32*b*) and positioning by a cam screw (38) allow the distance between the small arm (24) of the coupling spring (20) and the end of the control lever (10) to be modified, which thus allows manufacturing tolerances to be compensated for.

7 Claims, 5 Drawing Sheets

PRIOR ART

CHRONOGRAPH COUPLING MECHANISM

This application claims priority from Swiss Patent Application No. 1662/02, filed Oct. 4, 2002, the entire disclosure of which is incorporated herein by reference.

FEILD OF THE INVENTION

The present invention concerns a chronograph coupling mechanism using a control lever designed on the one hand, to prevent any blockage when passing from a stop position or a zero chronograph position to a working position, and on the other hand, for precisely adjusting the force exerted by the end of the lever, in a way reabsorbing the inevitable manufacturing tolerances of the moving parts forming the control of said coupling mechanism.

BACKGROUND OF THE INVENTION

In order to better understand the invention, we will first of all briefly describe the closest state of the art, to the best of the Applicant's knowledge, with reference to FIGS. 1 and 2 which show, schematically, in plan and cross-sectional views a control of coupling mechanism in the position where the chronograph is working. As can be seen in FIG. 1, the coupling device is actuated by a circular cam 1 having, on the exterior, a drive toothing 3 on which a manoeuvring lever, actuated by a push button (not shown), acts, said cam 1 being held in a determined position by means of a jumper spring 5. Cam 1 includes, on the inside, a second control toothing 2, whose teeth separating two successive hollows 4 of the toothing are truncated and have a flat 6. Outer toothing 3 includes twice as many teeth as inner toothing 2, such that, when driven through one step via actuation of a push button, a hollow 4 and a flat 6 are brought successively opposite a determined reference position. The control of coupling mechanism 10 is formed by a lever basically having three concurrent arms. A first arm 11 at its end pivoting at 12 in plate 7 or in a mechanism plate 8. A second arm 13 has at its end a tooth 14*a* held resting on a flat 6 of inner control toothing 2 by a return spring 9 stopped on a portion 14 bent into a Z shape. A third flexible arm 15 has at its end a fork 16, preceded by a V shaped fold 18 having a plane 18*a* inclined against an edge 8*a* of plate 8. In the coupled position shown in FIG. 2, coupling wheel 17 is driven, via the action of an annular leaf spring 21, by friction by the intermediate second wheel 19. When on wishes to stop the chronograph, an application of pressure on the push button causes cam 1 to rotate by a half-step and tooth 14*a* falls into a hollow 6, which causes inclined plane 18*a* to slide against edge 8*a* of plate 8 to a position in which V-shaped fold 18 is on plate 8, which allows fork 16 to disconnect coupling wheel 17 from intermediate second wheel 19 by compressing spring 21. In order for the coupling mechanism that has just been described to operate properly, it is thus necessary to be able to adjust precisely all the mechanical and physical parameters such as the tolerances as regards cam 1, control device 10 and the elasticity modules relating to return spring 9, arm 15 of control device 10 and annular spring 21.

With this device, a blockage of control device 10 is often observed during return to the stop or zero chronograph position, which can only be removed or reduced by providing elasticity modules, such that greater pressure has to be applied It will also be observed that in the stop or zero chronograph position, which is the position occupied for most of the time, flexible arm 15 is permanently stressed, which can obviously cause, at least partially, deformation that is detrimental to its elastic properties.

SUMMARY OF THE INVENTION

It is thus an object of the invention to overcome the two major drawbacks of the aforementioned prior art by providing a chronograph watch having a coupling device that is both reliable and easy to handle, and the operation of which can easily be adjusted at the end of assembly to take account of the cumulative effect of manufacturing tolerances.

The invention thus concerns a chronograph coupling mechanism using a fork which controls the axial movement of a coupling wheel to bring it into friction with an intermediate second wheel, or conversely, to move it away therefrom against the force of a return spring. This fork is actuated by a control lever to which a reciprocating movement is imparted, but according to a first feature of the invention, said fork is independent of the control lever unlike that which was stated hereinbefore for the prior art. This fork is in fact formed in the large arm of an element bent into an L shape, denoted hereinafter the "coupling spring", articulated at the junction of the two arms on the mechanism plate or on an adjustment plate, the small arm of said coupling spring being stressed at it base by the control lever.

According to another feature of the invention, the coupling spring is articulated in a hinge of an adjustment plate formed by a hinge plate, a spacer and a cover, assembled by two through studs whose ends are guided in translation by oblong apertures made in the mechanism plate and in the chronograph bridge. The plate forming the spacer includes an extension in which there is formed an oblong aperture having its large axis perpendicular to the alignment of the studs, which means that, by means of a cam, the distance between the end of the small arm of the coupling spring and the end of the control lever can be modified, and thereby, by means of a final adjustment, the manufacturing tolerances of the various parts of the coupling device can be compensated for.

According to a preferred embodiment, the control lever includes three concurrent branches, the first having its end pivoting in a mechanism plate, the second having its end held by a return spring resting against the inner toothing of an annular cam including a succession of hollows and flats, and the end of the third actuating the small arm of the coupling spring.

BRIEF DESCRITION OF THE DRAWING

The invention will be better understood upon reading the following description given by way of non limiting example with reference to the annexed drawings, in which.

Figure 4:
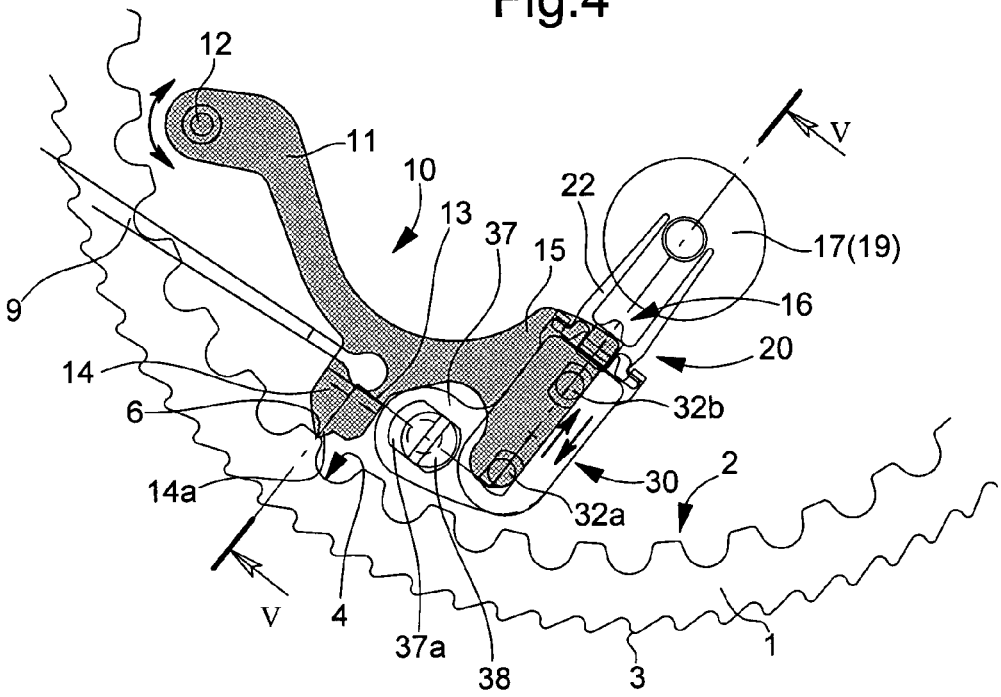
FIG. 4 is an enlarged view of the parts forming the coupling device in the stop or zero chronograph position.
Figure 6:
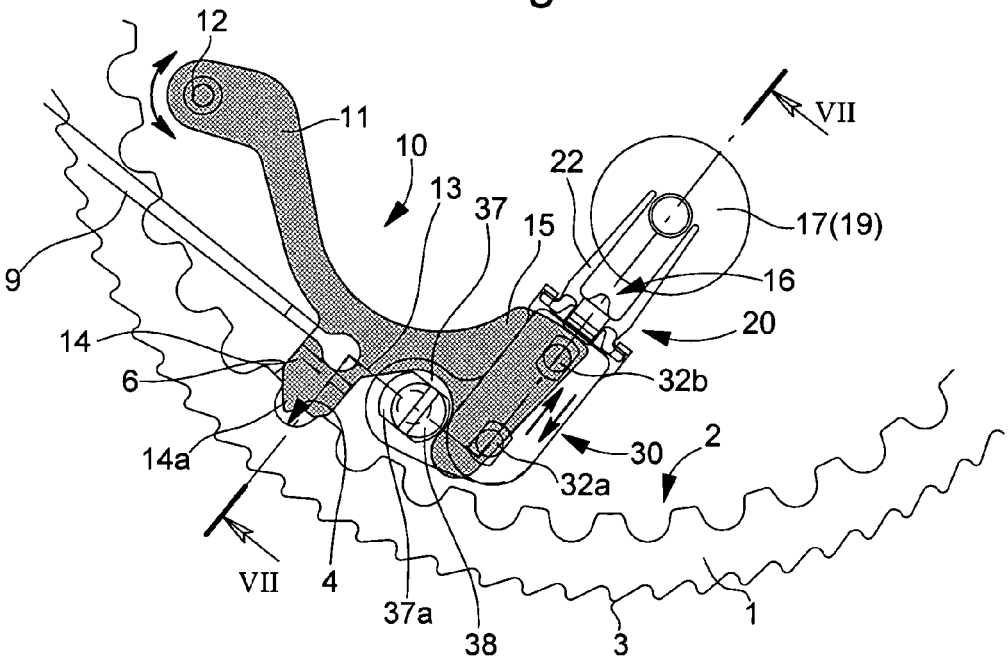
Figure 7:
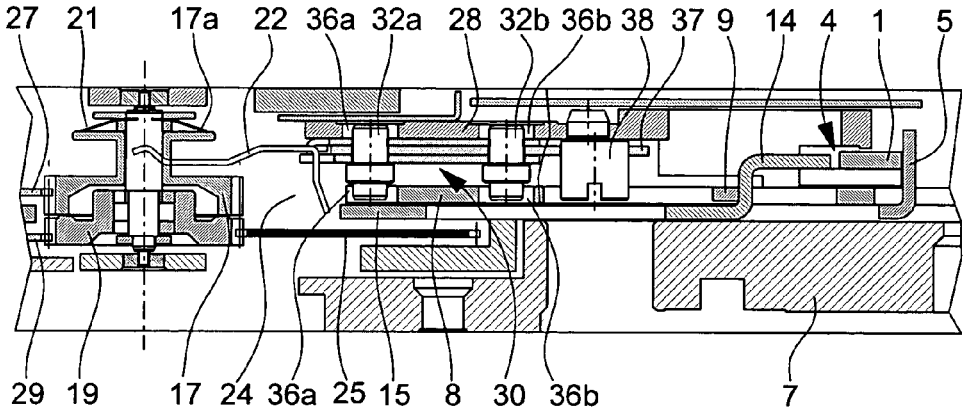
Figure 8:
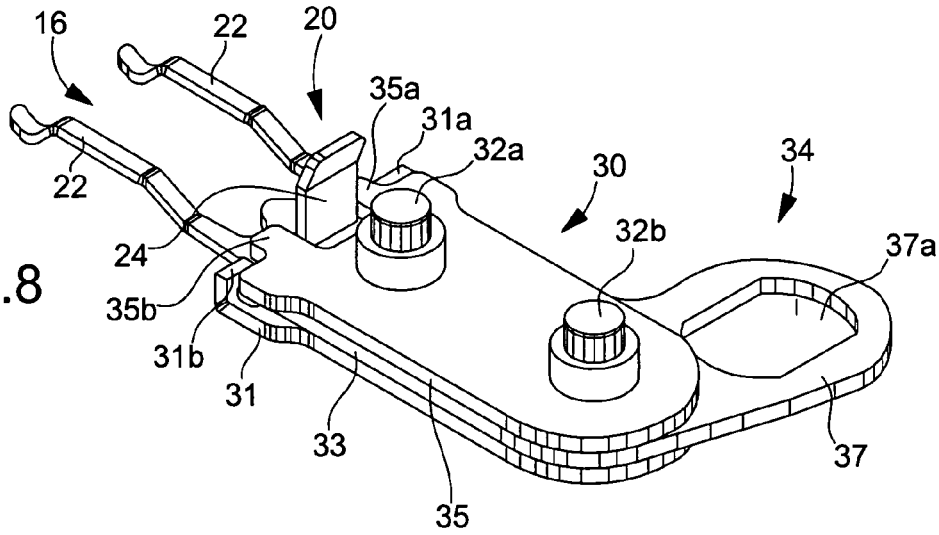
Figure 9:
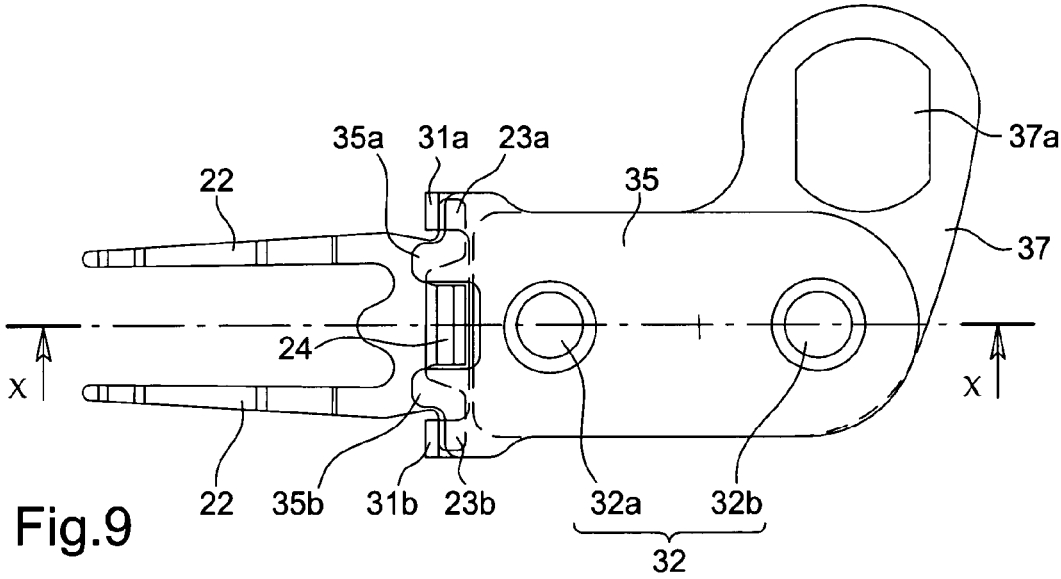

FIG. 6 corresponds to FIG. 4 when the coupling device is in the position in which the chronograph is working;

FIG. 7 is a broken interrupted cross-section of FIG. 6 along the lines VII—VII;

FIG. 8 is a perspective view of the adjusting plate of the coupling mechanism;

FIG. 9 is a top view of the adjusting plate shown in FIG. 8, and

Figure 10:
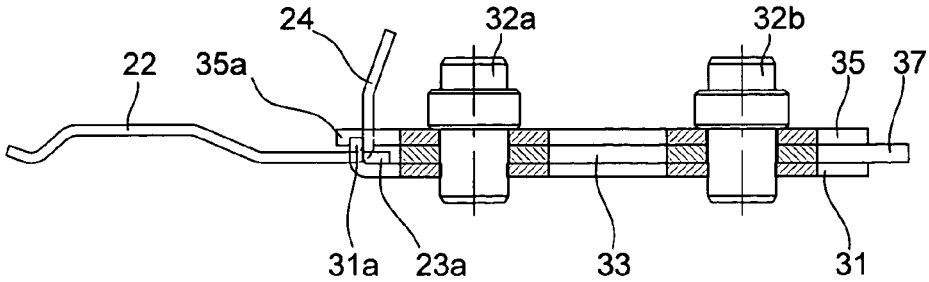

FIG. 10 is a cross-section of the mechanism of FIG. 8 along the line X—X.

DETAILED DESCRIPTION OF THE INVENTION

Figure 1:
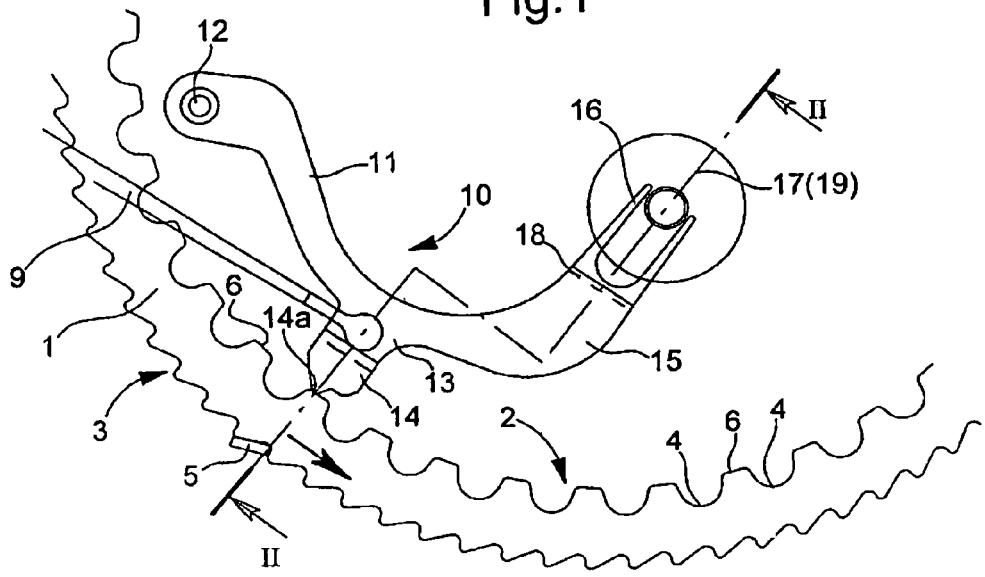
FIG. 1 shows a top view of a coupling device according to the prior art.
Figure 2:
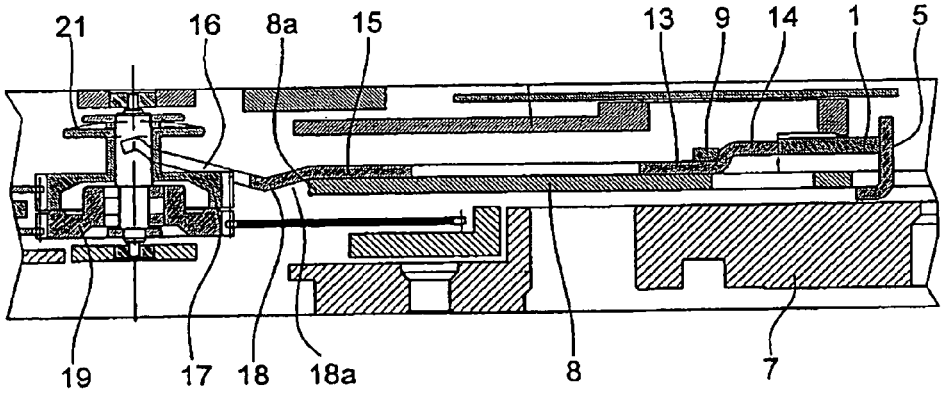
PRIOR ART Fig.2
FIG. 2 is a cross-section of FIG. 1 along the line 11.
Figure 3:
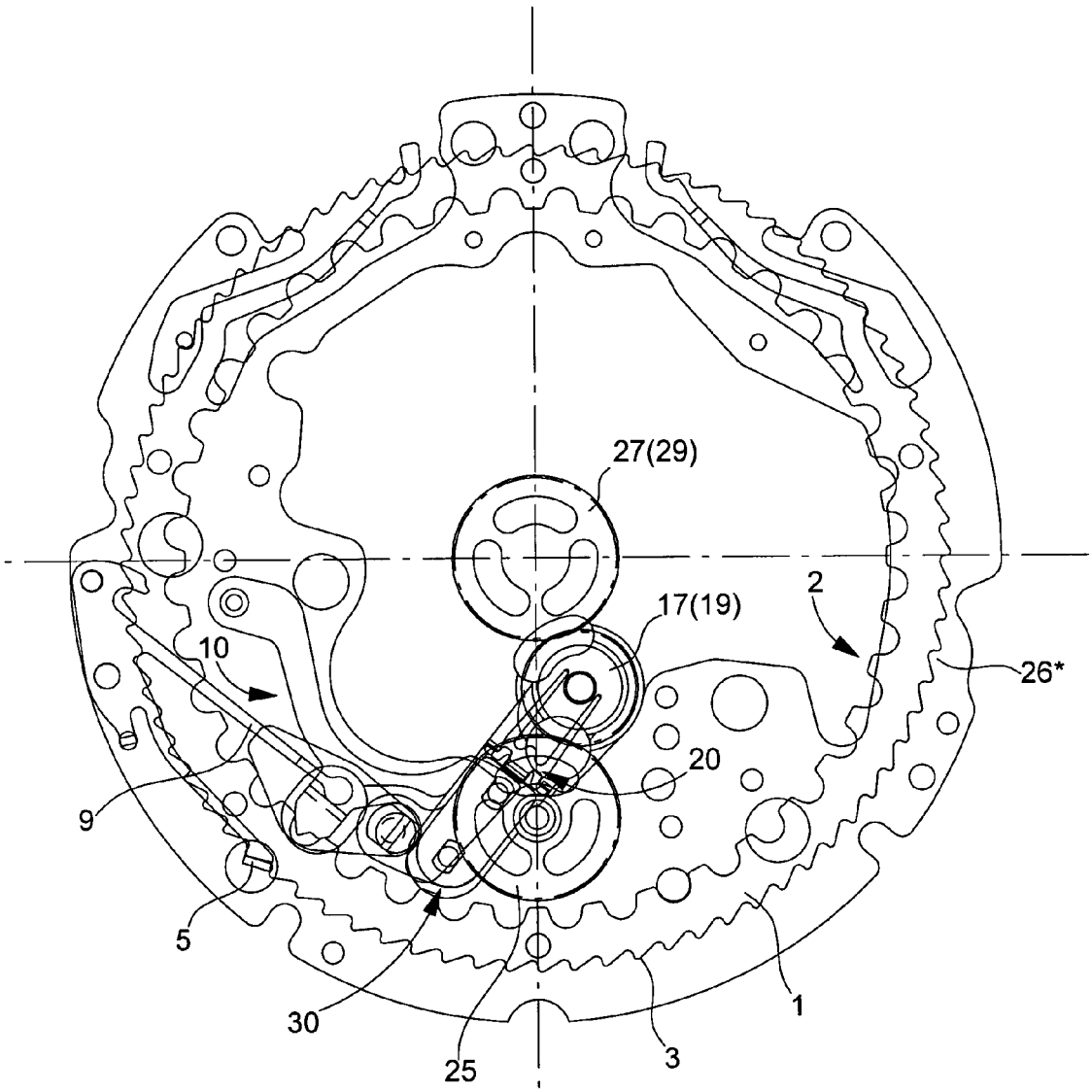
FIG. 3 shows a top view of the mechanism of a chronograph watch whose mechanism is limited to the coupling device according to the invention.
Figure 5:
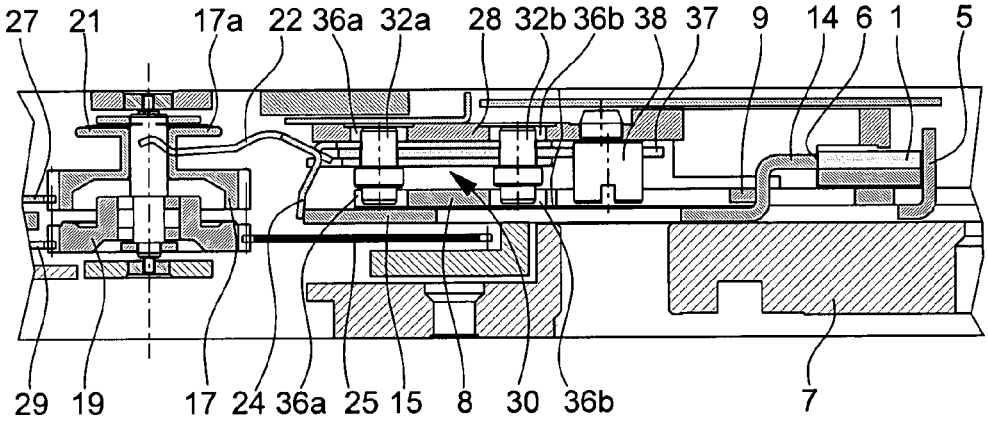
FIG. 5 is a broken interrupted cross-section of FIG. 6 along the lines V—V.

FIG. 3 shows a top view solely of the constituent parts of the coupling mechanism, shown further simplified but on a larger scale in FIG. 4, and in cross-section in FIG. 5. In FIGS. 3, 4 and 5, the coupling device is shown in the uncoupled position. As previously indicated, the change in position of the coupling device is controlled by a circular cam 1 driven in rotation by a finger 26, actuated by a push-button (not shown) and acting on an outer toothing 3, while being held in a determined position by a jumper spring 5. Cam 1 also includes an inner toothing 2, formed of a succession of hollows 4 and flats 6. The step ratio between inner toothing 2 and outer toothing 3 is 1:2 (for example 40 teeth inside and 80 teeth outside), such that the forward movement step-by-step of cam 1 alternately brings a hollow 4 and a flat 6 facing a reference position.

The coupling device as such includes, in a conventional manner, an intermediate second wheel 19, meshed with the driving wheel 29 and the small second wheel 25 and a coupling wheel 17, meshed with chronograph wheel 27 and having, on its top part, a collar 17*a* against which a return spring with an annular strip 21 presses, in order to hold the two wheel sets 17, 19 in the coupling position (as shown in FIG. 7), when there is no external stress.

In the example shown, the mechanism for acting on the coupling device, to make it pass into the uncoupling position by exerting pressure under collar 17*a*, includes three essential elements, namely, a control lever 10, an L-shaped coupling spring 20 and an adjusting plate 30.

Control lever 10, shown screened in FIG. 4 to show its contour better, includes three concurrent branches 11, 13 and 15. Branch 11 is pivoted at 12 in plate 7. Branch 13 has at one end a Z-shaped fold 14 that ends in a tooth 14*a* held against inner toothing 2 of cam 1 by a return spring 9 abutting against the vertical portion of fold 14. This Z-shaped fold of end 14 is only required by the placing of the wheel sets and other parts of the chronograph movement taken by way of example, but could equally be replaced by any other type of stop mechanism, such as a simple rib. The end of branch 15 is perpendicular to a radial direction of the rotational axis of wheel sets 17, 19 of the coupling device, but does not include any forks. It will be observed that the particular shape of each branch of control lever 10 depends solely on the place chosen or required for the moving parts forming the chronograph movement, and that any other shape that can be envisaged by those skilled in the art would still be within the scope of the present invention.

Coupling spring 20 includes a large arm 22 in which there is formed a fork 16 and a small arm 24 whose end is stressed by the end of branch 15 of control lever 10.

In the example shown, coupling spring 20 includes, on either side of the joining line of the two arms 22, 24, two small pivots 23*a*, 23*b* (visible in FIG. 9), mounted in a hinge of an adjustment plate 30, the construction of which will be described in more detail hereinafter. In a simpler embodiment, which is not shown, this coupling spring 20 could be directly fixed onto mechanism plate 8, or onto a part secured thereto.

Referring now also to FIGS. 8, 9 and 10, it can be seen that adjustment plate 30 is formed by two elements 31, 35 stacked on either side of a third element forming a spacer 33. Element 31 is a hinge and includes, close to the edges of one of its ends, two small extensions 31*a*, 31*b* extending beyond the edge of spacer 33, the extensions 31*a*, 31*b* having ends bent at right angles. Element 35 forming the cover is provided, at one of its extended ends, with two lugs 35*a*, 35*b* being located between the bent extensions 31*a*, 31*b*, the lugs extending slightly beyond the extensions 31*a*, 31*b*. These three elements 31, 33, 35 are assembled by two studs 32*a*, 32*b*, driven through holes provided in the elements, the heads of the studs 32*a*, 32*b* projecting from both sides of the stack to form guide means 32. Studs 32*a*, 32*b* are guided by oblong apertures 36*a*, 36*b* made in mechanism plate 8 and in chronograph bridge 28, which enables the shake of adjustment plate 30 to be limited.

It can also be seen that, on the side opposite the hinge, spacer 33 is provided with an extension 37 including an oblong aperture 37*a*, the large axis of which is perpendicular to the alignment of studs 32*a*, 32*b*. As is seen in FIGS. 4 and 5, oblong aperture 37*a* is intended to receive a cam 38, which will allow adjustment plate 30 to be moved, and thus the pressure exerted by the end of branch 15 of control lever 10 on the end of small arm 24 of coupling spring 20 to be adjusted. In the embodiment described, extension 37 is also oriented perpendicular to the alignment of studs 32*a*, 32*b*, but it is clear that said extension could be oriented in any other way provided that the large axis of the oblong aperture remains perpendicular to the alignment of the guide studs.

In operation, the coupling wheel 17 is brought into friction with an intermediate second wheel 19, or, conversely, to moved away therefrom by a fork 16 formed in the large arm 22 of an L-shaped coupling spring 20, articulated at the joining portion of the two arms 22, 24 on an adjustment plate 30, the small arm 24 of the coupling spring (20) having its end stressed by the end of a control lever 10. Means for guiding 32*a*, 32*b* and means for positioning by a cam screw 38 allow the distance between the small arm 24 of the coupling spring 20 and the end of the control lever 10 to be modified, which thus allows manufacturing tolerances to be compensated for.

This construction has essentially two advantages. By acting for example on the thicknesses, it allows one to have a control lever 10 that is rigid and without deformation and also a coupling spring 20 that has a certain flexibility preventing too much friction. By acting on cam screw 38, adjustment plate 30 compensates for the inevitable manufacturing tolerances, particularly as regards coupling spring 20, annular leaf spring 21 and cam 1. As is known, by being able to be slightly less rigorous as regards tolerances, it is possible to manufacture the same product at a slightly lower cost, while still retaining, thanks to the invention, high quality.

Returning to FIG. 4, it can be seen that in the uncoupled position, tooth 14*a* is held resting on flat 6 by spring 9, whereas in the coupling position shown in FIGS. 6 and 7, tooth 14*a* falls into a hollow 4. Cam 1 thus imparts a reciprocating movement on control lever 10, but it is clear that this movement could be obtained in any other manner known to those skilled in the art, without departing from the scope of the present invention.

What is claimed is:

1. A chronograph coupling mechanism comprising:

a fork controlling axial movement of a coupling wheel to bring the coupling wheel into friction with an intermediate second wheel, or, conversely, to move the coupling wheel away therefrom against a force of a return spring, said fork disposed to be actuated by a control lever performing a reciprocating movement; and a substantially L-shaped coupling spring having a large arm and a small arm, independent of the control lever and articulated at the junction of the large arm and the small arms on a mechanism plate or on an adjustment plate, wherein the large arm of said coupling spring includes the fork and the small arm is disposed to be actuated by one end of the control lever.

2. The coupling mechanism according to claim 1, wherein the coupling spring is articulated on the adjustment plate including means for guiding and means for positioning the small arm of said coupling spring with respect to an end of the small arm.

3. The coupling mechanism according to claim 2, wherein the guide means is formed by two studs allowing the adjustment plate to have a shake limited by oblong apertures made in the mechanism plate and in a chronograph bridge, said studs being driven through a hinge plate, a spacer and a cover, to form together at one end a hinge of the coupling spring.

4. The coupling mechanism according to claim 2, wherein the guide means is formed by studs and the positioning means is formed by an extension of a spacer including an oblong aperture whose large axis is substantially perpendicular to the studs, wherein said oblong aperture is disposed to receive a cam.

5. The coupling mechanism according to claim 4, wherein the extension forming the positioning means is substantially perpendicular to the studs of the guide means.

6. The coupling mechanism according to claim 1, wherein the control lever includes three concurrent branches, a first branch having an end pivoting in the mechanism plate, a second branch having an end held by the return spring resting against inner toothing of an annular cam including a succession of hollows and flats, and an end of the third branch is disposed to allow the small arm of the coupling spring to be actuated.

7. The coupling mechanism according to claim 6, wherein the end of the second branch of the control lever is bent in a Z-shape to form a stop for the return spring.

* * * * *